US011260681B2

(12) United States Patent
Caga-anan et al.

(10) Patent No.: US 11,260,681 B2
(45) Date of Patent: Mar. 1, 2022

(54) PRINT MEDIUM POSITION DETECTION

(71) Applicant: Hewlett-Packard Development Company, L.P., Spring, TX (US)

(72) Inventors: Mark Caga-anan, Singapore (SG); Yong Poo Heng, Singapore (SC); Wei Lit Teoh, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 6 days.

(21) Appl. No.: 16/483,281

(22) PCT Filed: Feb. 7, 2017

(86) PCT No.: PCT/US2017/016839
§ 371 (c)(1),
(2) Date: Aug. 2, 2019

(87) PCT Pub. No.: WO2018/147832
PCT Pub. Date: Aug. 16, 2018

(65) Prior Publication Data

US 2020/0009887 A1 Jan. 9, 2020

(51) Int. Cl.
*B41J 15/04* (2006.01)

(52) U.S. Cl.
CPC ..... *B41J 15/046* (2013.01)

(58) Field of Classification Search
CPC ..... B65H 5/068; B65H 9/004; B41J 15/046
See application file for complete search history.

(56) References Cited

U.S. PATENT DOCUMENTS

| | | | | |
|---|---|---|---|---|
| 6,789,876 | B2 | 9/2004 | Barclay et al. | |
| 8,469,476 | B2 | 6/2013 | Mandel et al. | |
| 9,181,050 | B2 | 11/2015 | Machida et al. | |
| 9,517,905 | B2 * | 12/2016 | Yoshimizu | B65H 5/068 |
| 2007/0023994 | A1 | 2/2007 | Mandel et al. | |
| 2009/0257808 | A1 | 10/2009 | Krucinski | |

FOREIGN PATENT DOCUMENTS

| | | | |
|---|---|---|---|
| JP | 2005103835 | A | 4/2005 |
| KR | 20080067862 | A | 7/2008 |

OTHER PUBLICATIONS

Hensel, S. ~ "Precision Makes a Great Impression" ~ AutoMotion ~ Mar. 2016 ~ 4 pages.

* cited by examiner

*Primary Examiner* — Lam S Nguyen
(74) *Attorney, Agent, or Firm* — HP Inc. Patent Department

(57) ABSTRACT

The present subject matter discloses detection of positions of print medium for driving the print medium for printing in a printing system, in an example implementation, a motor is operated for driving the print medium, at a first specific speed, along a media-path in the printing system. After a first specific number of rotations of the motor, it is detected, based on identification of a torque change event, that the print medium at a de-skew position in the media-path. At the de-skew position a leading edge of the print medium is at a de-skew unit of the printing system and the torque change event is indicative of a deviation in a current operating torque of the motor from a standard operating torque of the motor.

12 Claims, 9 Drawing Sheets

PRINT MEDIUM POSITION DETECTION

BACKGROUND

Positions of a print medium along a media-path in a printing system may be detected for driving the print medium along the media-path for printing. Various positions of the print medium may be detected which enables the printing system to control speed of movement of the print medium, stop movement of the print medium at a specified position in the media-path, and detect print media jams.

BRIEF DESCRIPTION OF DRAWINGS

The following detailed description references the drawings, wherein.

DETAILED DESCRIPTION

Figure 1:
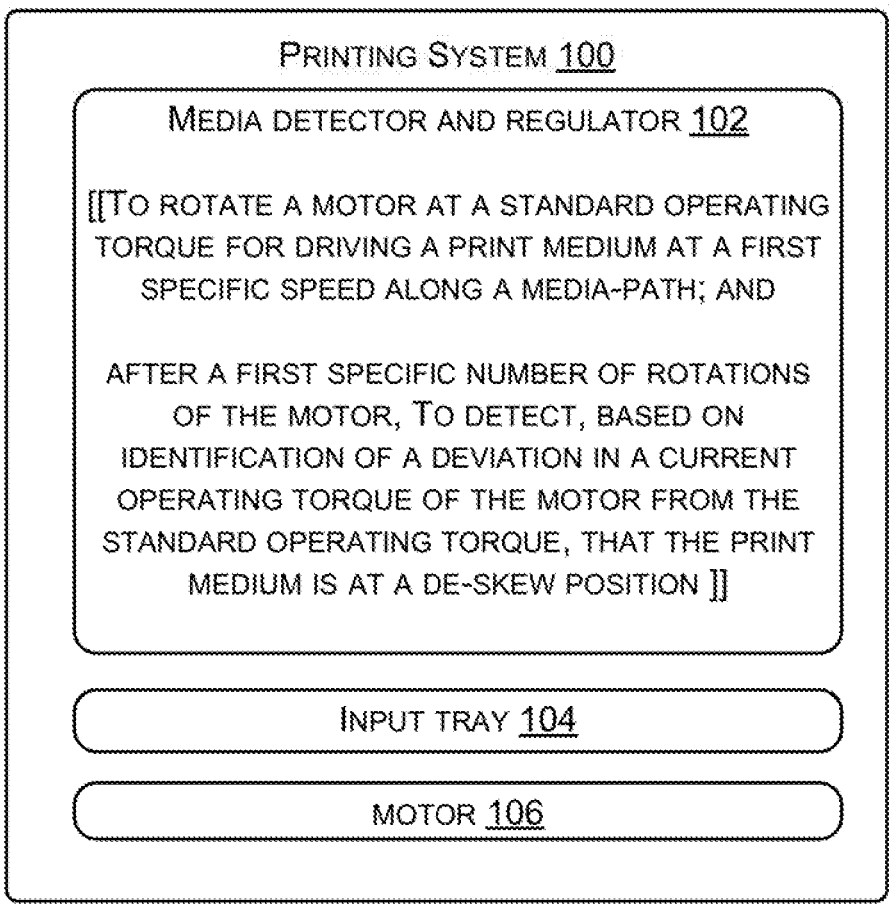
FIG. 1 illustrates a printing system having a media detector and regulator, according to an example implementation of the present subject matter.

The present subject matter describes detecting positions of a print medium, such as paper, which is driven along a media-path of a printing system for printing. The media-path may be a pathway, from an input tray to a discharge unit, in the printing system along which the print medium may be transferred for printing. The positions of the print medium that may be detected include a de-skew position and a separation position. At the de-skew position, a leading edge of the print medium is at a de-skew unit of the printing system which performs a de-skew operation to straighten folded or bent edges of the print medium. At the separation position, the leading edge of the print medium is at a separation unit of the printing system which performs a separation operation on the print medium to prevent multiple print media from entering the media-path simultaneously.

The positions of the print medium along the media-path are generally detected by sensors, for example, opto-interrupter sensors or reflectance sensors positioned in the media-path. The sensors positioned in the media-path sense the position of a leading edge of the print medium and provide information of the sensed position to a control unit of the printing system. The information of the sensed position may identify that the print medium is at a specific position, such as the de-skew position or the separation position, in the media-path. The control unit based on the information of the sensed position may regulate a speed of movement of the print medium along the media-path. The information of the sensed position may also be used by the control unit for sequencing or scheduling different operations of the printing system, such as pick, feed, and discharge of the print medium.

Mounting and assembling of sensors in the media path involves complex arrangement of sensor sub-systems which makes the printing system complex and bulky. Also, the sensor sub-systems often include small springs and other fragile mechanical parts, which may get damaged during handling and assembly. Due to the complexity in assembly of the sensors and risk of damaging of the sensors, there may be chances of improper assembly of the sensors which may give rise to faults in sensing the position of the print medium. Further, the sensors used in the printing system are expensive and adds to the overall cost of the printing system.

In some printing systems, such as large format printers (LFPs) interfaced with an input accessory tray, the sensors may be mounted on the input accessory tray. In such printing systems, electrical interconnects or wires are used for making connections between the sensors and other internal components of the printing system. These electrical interconnects may be fragile and may get damaged easily, which may affect the reliability of detection of position of the print medium. Further, the use of robust electrical interconnects may increase the cost of the printing system.

The present subject matter describes methods and printing systems for detecting positions of a print medium for driving the print medium for printing. The methods and the printing systems of the present subject matter enable detection of positions of the print medium without the use of sensors. Thus, the printing systems of the present subject matter are less bulky, have a less complex assembly, and are modular as compared to the printing systems with position detection sensors. The elimination of the position detection sensors also enables reduction of cost of the printing systems.

In accordance with an example implementation of the present subject matter, a motor in the printing system is operated for driving the print medium, at a first specific speed, along a media-path in the printing system. Operation of the motor includes rotation of the motor. After a first specific number of rotations of the motor, the print medium is detected to be at a de-skew position in the media-path based on identification of a torque change event of the motor. At the de-skew position, a leading edge of the print medium is at a de-skew unit of the printing system. The torque change event indicates a deviation in a current operating torque of the motor from a standard operating torque of the motor. The current operating torque may be defined as the instantaneous output torque of the motor for driving the print medium along the media-path. The standard operating torque is an average output torque over a time period of operation of the motor when there is no internal resistance to movement of the print medium along the media-path. The internal resistance may be defined as a mechanical resistance to movement of the print medium offered by various internal units/components, such as the separation unit and the de-skew unit, of the printing system for performing their respective functions.

In an example implementation, upon detecting that the print medium is at the de-skew position, rotation of the motor may be regulated for driving the print medium towards a printing unit of the printing system for printing.

In an example implementation, the methods and systems of the present subject matter may also detect, based on identification of another torque change event of the motor, that the print medium is at a separation position in the media-path. At the separation position, a leading edge of the print medium is at the separation unit of the printing system.

Detection of positions of the print medium based on deviations in the current operating torque of the motor allows elimination of position detection sensors. The elimination of such sensors reduces complexity in assembly of the printing systems and makes the printing systems modular. Also, the risks associated with the sensors getting damaged during handling or assembly and consequent faults in detection of positions of the print medium is minimized. Thus, the printing systems of the present subject matter are robust and enable in reliable detection of positions of the print medium in the media-path.

Further, elimination of position detection sensors may also eliminate the use of electrical interconnects for the sensors. Elimination of the electrical interconnects further enhances the modularity of the printing systems. Also, without the sensors and their electrical interconnects, the manufacturing cost of the printing systems of the present subject matter is reduced as compared to printing systems with the sensors.

The following detailed description refers to the accompanying drawings. Wherever possible, the same reference numbers are used in the drawings and the following description to refer to the same or similar parts. While several examples are described in the description, modifications, adaptations, and other implementations are possible. Accordingly, the following detailed description does not limit the disclosed examples. Instead, the proper scope of the disclosed examples may be defined by the appended claims.

FIG. 1 illustrates a printing system 100 having a media detector and regulator 102, according to an example implementation of the present subject matter. The printing system 100 may be a printer, such as an inkjet printer, a large format printer (LFP), or the like.

In an example implementation, the media detector and regulator 102 may be implemented as hardware, such as a processor(s) or through logical instructions or a combination thereof. In an example implementation, the processor(s) may be external to the media detector and regulator 102 and may be coupled to the media detector and regulator 102. The processor(s) may be implemented as microprocessors, microcomputers, microcontrollers, digital signal processors, central processing units, state machines, logic circuitries, and/or any devices that manipulate signals based on operational instructions. Among other capabilities, the processor(s) may fetch and execute computer-readable instructions stored in a memory coupled to the processor(s). The memory can be internal or external to the printing system 100. The memory may include any non-transitory computer-readable storage medium including, for example, volatile memory (e.g., RAM), and/or non-volatile memory (e.g., EPROM, flash memory, NVRAM, memristor, etc.). The functions of the various elements shown in FIG. 1, including any functional blocks labeled as "processor(s)", may be provided through the use of dedicated hardware as well as hardware capable of executing computer-readable instructions.

The media detector and regulator 102 amongst other things, include routines, programs, objects, components, data structures, and the like, which perform particular tasks or implement particular abstract data types. The media detector and regulator 102 may be coupled to, and executed by, processor(s) to perform various functions for the purpose of detecting positions of the print medium for driving the print medium for printing, in accordance with the present subject matter. In an example implementation, the media detector and regulator 102 may be coupled to, and executed by, the processor(s) to perform various other functions for the purpose of controlling speed of movement of the print medium along the media-path, stopping the print medium once the print medium reaches a specific position in the media-path, and detecting print media jams.

The printing system 100 includes an input tray 104. The input tray 104 may be an L-tray, an accessory tray, or the like. Print media, such as sheets of paper may be loaded on the input tray 104. The print media may include, for example, plain paper or photo paper and may be of A3 or A4 size.

The printing system 100 further includes a motor 106. In an example implementation, rotation of the motor 106 may be controlled by the media detector and regulator 102 through pulse width modulation (PWM) signals. In an example implementation, the motor 106 is operated to drive a print medium from the input tray 104 along a media-path of the printing system 100. The media-path of the printing system 100 is a path along which the print medium from the input tray 104 may be transferred to a printing unit (not shown) of the printing system 100 for printing.

In an example implementation, the motor 106 may be a pick motor coupled to a pick roller (not shown) of the printing system 100. The pick motor may rotate the pick roller which in turn may pick a print medium from the input tray 104 and drive the print medium along the media-path. In another example implementation, the motor 106 may be a multi-purpose motor that may operate as a primary feed motor for feeding the print medium to a printing unit (not shown) of the printing system 100, and also operate as a pick motor coupled to the pick roller, to drive the pick roller to pick and drive the print medium.

In an example implementation, the media detector and regulator 102 may include an encoder. The encoder may be, for example, a rotary encoder. The encoder may be coupled to the motor 106 and may indicate angular position of the shaft of the motor 106 in terms of an encoder count which may be stored in a memory by the media detector and regulator 102. The media detector and regulator 102 may also be configured to measure an output torque of the motor 106.

In an example implementation, the media detector and regulator 102 may generate control instructions to rotate the motor 106 at a standard operating torque for driving the print medium, at a first specific speed, along the media-path. The control instructions may be in the form of PWM signals. In an example implementation, for plain paper of A4 size, the standard operating torque may be in a range of about 5 ounce inches to about 10 ounce inches. In another example implementation, for plain paper of A3 size or photo paper of A3/A4 size, the standard operating torque may be in a range of about 10 ounce inches to about 15 ounce inches. In an example implementation, the first specific speed of the print medium may be 10 inches per second (ips).

The media detector and regulator 102 generates the control signals to rotate the motor 106 for a first specific number of rotations. In an example implementation, the first specific number of rotations may be expressed in terms of a number of encoder counts of the motor 106. In an example implementation, for Ink-et printers, the first specific number of rotations may be pre-set and stored in the memory of the printing system 100. The first specific number of rotations may range between 6000 encoder counts and 8000 encoder counts.

After the motor 106 completes the first specific number of rotations, the media detector and regulator 102 detects, based on a deviation in the current operating torque of the motor 106 from the standard operating torque, that the print medium is at a de-skew position. At the de-skew position, a leading edge of the print medium is at a de-skew unit (not shown) of the printing system 100. In an example implementation, the de-skew unit may include a transfer roller of the printing system 100 which performs a de-skew operation on the print medium. In another example implementation, the de-skew unit may include a feed roller of the printing system 100 which performs the de-skew operation. The de-skew operation refers to straightening of bent or skewed edges of the print medium.

Once it is detected that the print medium is at the de-skew position, the media detector and regulator 102 may control speed of movement of the print medium for driving the print medium for printing. In an example implementation, based on the detected position of the print medium, the media detector and regulator 102 may schedule other operations, such as feeding the print medium to a printing unit (not shown) of the printing system 100 for printing.

An example procedure of detecting positions of a print medium in a media-path for driving the print medium for printing in the printing system 200 is described in detail with reference to FIG. 2.

Figure 2:
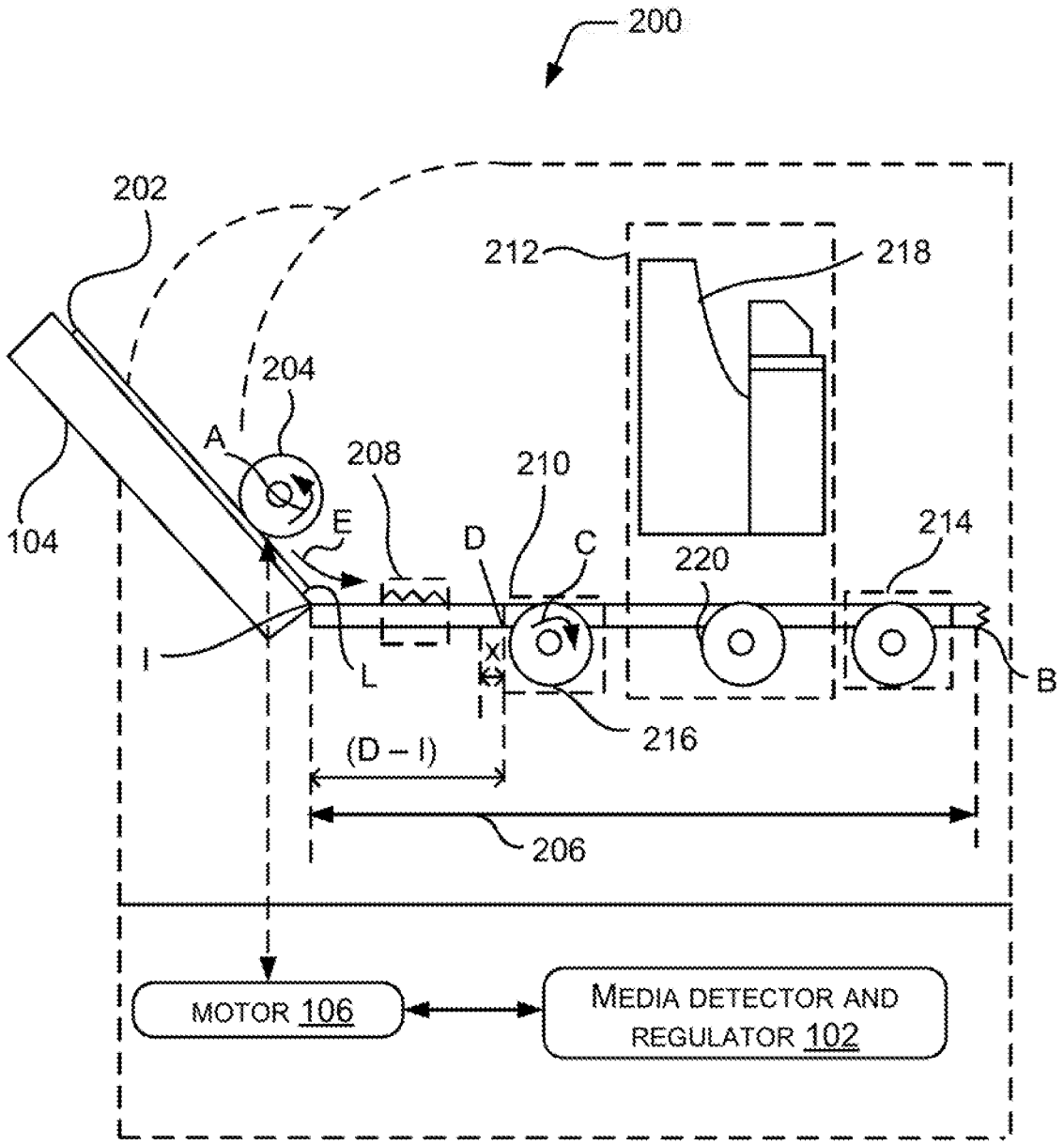
FIG. 2 illustrates a printing system having the media detector and regulator, according to another example implementation of the present subject matter.

FIG. 2 illustrates a printing system 200 having the media detector and regulator 102, according to an example implementation of the present subject matter. The printing system 200 includes the input tray 104. The input tray 104 may be loaded with a print medium 202. The printing system 200 also includes a pick roller 204 which can pick the print medium 202 from the input tray 104 for driving the print medium 202 along a media-path 206 of the printing system 200 for printing. The media-path 206, as indicated, extends from a base 'I' of the input tray 104 to a discharge point 'B' where the print medium 202 is dispensed from the printing system 200 after printing.

The printing system 200 further includes a separation unit 208. The separation unit 208 may include a serrated separation wall, a separation roller, or some other element offering mechanical resistance to movement of the print medium 202. The separation unit 208 offers a frictional resistance to movement of the print medium, when a leading edge L of a print medium is at the separation unit 208, to prevent multiple print media entering simultaneously into the media-path 206. In a scenario where multiple print media may be picked up by the pick roller 204, the separation unit 208 separates a single print medium from the multiple picked print media and allows the single print medium to be forwarded in the media-path 206.

To drive the print medium 202 beyond the separation unit 208, a current operating torque of the motor 106 is increased, by a feedback mechanism (not shown) of the motor 106, from the standard operating torque to a separation position torque so that the frictional resistance at the separation unit 208 is overcome. The separation position torque may be defined as an output torque of the motor 106 when the leading edge L of the print medium 202 is at the separation unit 208. In an example implementation, the separation position torque may range between 25 ounce inches to 50 ounce inches. The separation position torque may be pre-set and stored in the memory (not shown) of the printing system 200. Thus, when the leading edge L of the print medium 202 is at the separation unit 208, the increase in the current operating torque of the motor 106 is identified by the media detector and regulator 102 as a deviation of the current operating torque from the standard operating torque. This deviation in the current operating torque from the standard operating torque to the separation position torque is referred to as a first torque change event.

The printing system 200 also includes a de-skew unit 210, a printing unit 212, and a discharge unit 214. The de-skew unit 210, as shown in FIG. 2, is at point D in the media-path 206. The de-skew unit 210 includes a de-skew roller 216. Although FIG. 2 shows the de-skew unit 210 with a single de-skew roller 216, in an example implementation, the de-skew unit 210 may include a roller assembly. The de-skew roller 216 may perform a de-skew operation for straightening bent or skewed edges of the print medium 202 as the print medium 202 passes over the de-skew roller 216. In an example implementation, the de-skew roller 216 may also be a transfer roller of the printing system 200, where the transfer roller moves the print medium 202 along the media-path 206 towards the printing unit 212. In the de-skew unit 210, the de-skew roller 216 may be rotated in a direction, as depicted by arrow C, opposite to the direction of rotation of the pick roller 204 for performing the de-skew operation. In another example implementation, the de-skew operation may be performed by a stationary de-skew roller.

The de-skew roller 216 offers a frictional resistance to movement of the print medium 202, when the leading edge L of the print medium 202 is at the de-skew unit 210. To drive the print medium 202 beyond the de-skew unit 210, the current operating torque of the motor 106 is increased, by the feedback mechanism (not shown) of the motor 106, from the standard operating torque to a de-skew position torque so that the frictional resistance at the de-skew unit 210 is overcome. The de-skew position torque may be defined as the output torque of the motor 106 when the leading edge L of the print medium 202 is at the de-skew unit 210. In an example implementation, the de-skew position torque may range between 20 ounce inches to 50 ounce inches. The de-skew position torque may be pre-set and may be stored in the memory (not shown) of the printing system 200. Thus, when the leading edge L of the print medium 202 is at the de-skew unit 210, the increase in the current operating torque of the motor 106 is identified by the media detector and regulator 102 as a deviation of the current operating torque from the standard operating torque. This deviation in the current operating torque from the standard operating torque to the de-skew position torque is referred to as a second torque change event.

The printing unit 212 includes a carriage 218 loaded with an ink cartridge (not shown) for printing and a feed roller 220 which positions the print medium 202 during printing. In an example implementation, in absence of a separate de-skew unit, the feed roller of the printing unit may also function as the de-skew roller. Once printing of the print medium 202 at the printing unit 212 is complete, the print medium 202 may be dispensed from the printing system 200 by the discharge unit 214. The discharge unit 214 may include a single roller or a roller assembly to discharge the print media from the printing system 200.

The printing system 200 also includes the motor 106. In an example implementation, the motor 106 may be a motor coupled to the pick roller 204. The motor 106 may rotate the pick roller 204 which in turn picks up the print medium 202 from the input tray 104. The rotation of the pick roller 204 may also drive the print medium 202 along the media-path 206.

In an example implementation, the media detector and regulator 102 may detect various positions of the print medium 202 in the media-path 206. In an example implementation, the media detector and regulator 102 may detect the print medium 202 at the de-skew position. In another example implementation, the media detector and regulator 102 may first detect the print medium 202 at the separation position and then detect the print medium 202 at the de-skew position.

The following description describes in detail an example procedure of detection of the print medium 202 being at the separation position and at the de-skew position by the media detector and regulator 102.

During operation of the printing system 200, the media detector and regulator 102 rotates the motor 106 at a standard operating torque for driving the print medium 202 at a first specific speed along the media-path 206. On rotation of the motor 106, the pick roller 204 coupled to the motor 106 is rotated in a direction depicted by arrow A which in turn may pick up the print medium 202 from the input tray 104 and drive the print medium 202 at the first specific speed into the media-path 206 in a direction depicted by arrow E towards the separation unit 208.

In an example implementation, the first specific speed may be 10 inches per second (ips). The first specific speed may be pre-set and stored in the memory (not shown) of the printing system 200. In an example implementation, the standard operating torque may also be pre-set and stored in the memory (not shown) of the printing system 200. In another example implementation, the media detector and regulator 102 may determine the standard operating torque by calculating an average output torque of the motor 106 for driving the print medium 202 at the first specific speed. In an example implementation, the media detector and regulator 102 may calculate the average output torque over 20 encoder counts to 40 encoder counts of rotation of the motor 106.

As the print medium 202 moves along the media-path 206 at the first specific speed, a leading edge L of the print medium 202 moves towards the separation unit 208. The media detector and regulator 102 identifies the first torque change event to detect that the print medium 202 is at the separation position.

In an example implementation, the media detector and regulator 102 may detect that the print medium 202 is at the separation position in a manner as described below.

The media detector and regulator 102 compares the current operating torque of the motor 106 with the separation position torque. When the current operating torque of the motor 106 matches with the separation position torque, the media detector and regulator 102 identifies the first torque change event to detect that the print medium 202 is at the separation position.

After a first rotation interval, when the current operating torque of the motor 106 does not match with the separation position torque, the media detector and regulator 102 identifies that the input tray 104 is out of paper. The first rotation interval is expressed in terms of a specific number of rotations of the motor 106. In an example implementation, the first rotation interval may range from about 36000 encoder counts to about 50000 encoder counts of rotation of the motor 106.

In another example implementation, the media detector and regulator 102 may detect that the print medium 202 is at the separation position in a manner as described below.

The media detector and regulator 102 determines a moving average torque of the motor 106. The moving average torque may be defined as a moving average value of the current operating torque of the motor 106. In an example implementation, the media detector and regulator 102 may include a moving average filter (not shown) to determine the moving average torque. The media detector and regulator 102 also determines a torque deviation of the motor 106. The torque deviation is a difference between the moving average torque of the motor 106 and the standard operating torque. The media detector and regulator 102 then compares the torque deviation with a separation position torque deviation. The separation position torque deviation may be defined as a specific difference between a moving average torque of the motor 106 when the leading edge L of the print medium is at the separation unit and the standard operating torque. In an example implementation, the separation position torque deviation may be about 50% to about 100% of the standard operating torque and may be pre-set and stored in the memory of the printing system 200. When the torque deviation of the motor 106 matches with the separation position torque deviation, the media detector and regulator 102 identifies the first torque change event to detect that the print medium 202 is at the separation position.

After the first rotation interval, when the torque deviation of the motor 106 does not match with the separation position torque deviation, the media detector and regulator 102 identifies that the input tray 104 is out of paper.

In an example implementation, when it is detected that the print medium is at the separation position, the media detector and regulator 102 may regulate rotation of the motor 106 for driving the print medium 202 from the separation unit 208 towards the de-skew unit 210. In an example implementation, to regulate the rotation of the motor 106, the media detector and regulator 102 may capture a separation position snapshot indicative of a position of the shaft of the motor 106 when the print medium 202 is at the separation position. The separation position snapshot may be expressed in terms of encoder counts and may be stored in the memory. Upon capturing the separation position snapshot, the media detector and regulator 102 rotates the motor 106 for driving the print medium 202 at a first specific regulated speed. In an example implementation, the first specific regulated speed may be 16 ips.

The motor 106 is rotated to drive the print medium 202 at the first specific regulated speed until the motor 106 completes a first specific number of rotations. The first specific number of rotations of the motor 106 drives the print medium 202 for a first specific distance along the media-path 206 in the direction of arrow E. With reference to FIG. 2, the first specific distance may be defined as [(D−I)−x], where (D−I) is a distance of the de-skew unit 210 from the base I of the input tray 104 and 'x' represents a pre-set distance. In an example implementation, the value of (D−I) may range from about 70 mm to about 90 mm, and the value of 'x' may be 10 mm. Thus, the first specific distance may range from about 60 mm to 80 mm, and the first specific number of rotations may range from about 6000 encoder counts to about 8000 encoder counts. The first specific number of rotations may be pre-set and stored in the memory of the printing system 200.

As the print medium 202 moves along the media-path 206 at the first specific regulated speed, a leading edge L of the print medium 202 moves towards the de-skew unit 210. The media detector and regulator 102, based on identification of the second torque change event, detects that the print medium 202 is at the de-skew position.

In an example implementation, the media detector and regulator 102 may detect that the print medium 202 is at the de-skew position in a manner as described below.

The media detector and regulator 102 checks whether the motor 106 has completed the first specific number of rotations. When the media detector and regulator 102 determines that the print medium 202 has completed the first specific number of rotations, the media detector and regulator 102 rotates the motor 106 for driving the print medium 202 at a second specific speed towards the de-skew unit 210. In an example implementation, the second specific speed may be 5 ips.

The media detector and regulator 102 sets a stall torque of the motor 106 to be equal to the de-skew position torque. The stall torque of a motor may be defined as the maximum output torque of a powered up motor when the shaft of the motor is maintained stationary. The stall torque may also be defined as a torque load that causes the output rotational speed of the motor to become zero, i.e., causes stalling. When the current operating torque of the motor equals the stall torque, the media detector and regulator 102 identifies that the motor 106 is stalled. When the motor 106 is stalled, the media detector and regulator 102 identifies the second torque change event to detect that the print medium is at the de-skew position.

After a second rotation interval, when the motor 106 does not stall, the media detector and regulator 102 identifies a media jam in the media-path 206. The media jam refers to a condition when a print medium is stuck in the media-path 206 and thus blocks the media-path 206. The second rotation interval is expressed in terms of a specific number of rotations of the motor 106. In an example implementation, the second rotation interval may range from about 36000 encoder counts to about 50000 encoder counts of rotation of the motor 106.

In another example implementation, the media detector and regulator 102 may detect that the print medium 202 is at the de-skew position in a manner as described below.

The media detector and regulator 102 checks whether the motor 106 has completed the first specific number of rotations. When the media detector and regulator 102 determines that the print medium 202 has completed the first specific number of rotations, the media detector and regulator 102 rotates the motor 106 for driving the print medium 202 at the second specific speed towards the de-skew unit 210.

The media detector and regulator 102 compares the current operating torque of the motor 106 with the de-skew position torque. When the current operating torque of the motor 106 matches with the de-skew position torque, the media detector and regulator 102 identifies the second torque change event to detect that the print medium is at the de-skew position.

After the second rotation interval, when the current operating torque of the motor 106 does not match with the de-skew position torque, the media detector and regulator 102 identifies a media jam in the media-path 206.

In another example implementation, the media detector and regulator 102 may detect that the print medium 202 is at the de-skew position in a manner as described below.

The media detector and regulator 102 determines a moving average torque of the motor 106. The moving average torque may be defined as a moving average value of the current operating torque of the motor 106. The media detector and regulator 102 determines a torque deviation of the motor 106. The torque deviation is a difference between the moving average torque of the motor 106 and the standard operating torque. The media detector and regulator 102 checks whether the motor 106 has completed the first specific number of rotations. When the motor 106 has completed the first specific number of rotations, the media detector and regulator 102 rotates the motor 106 for driving the print medium 202 at the second specific speed. The media detector and regulator 102 compares the torque deviation with a de-skew position torque deviation. The de-skew position torque deviation may be defined as a specific difference between a moving average torque of the motor 106 when the leading edge L of the print medium is at the de-skew unit and the standard operating torque. In an example implementation, the de-skew position torque deviation may be 50% to 100% of the standard operating torque and may be pre-set and stored in the memory (not shown) of the printing system. When the torque deviation of the motor 106 matches with the de-skew position torque deviation, the media detector and regulator 102 identifies the second torque change event to detect that the print medium is at the de-skew position.

After the second rotation interval, when the torque deviation of the motor 106 does not match with the de-skew position torque deviation, the media detector and regulator 102 identifies a media jam in the media-path 206.

In an example implementation, upon detecting that the print medium 202 is at the de-skew position, the media detector and regulator 102 may regulate rotation of the motor 106 for driving the print medium 202 to a target position (not shown) in the media-path 202. In an example implementation, the target position is a position of the print medium 202 in the media-path 206 before the print medium is fed to the printing unit 212 for printing.

In an example implementation, when the de-skew position is detected based on stalling of the motor 106, the target position is the de-skew position and the media detector and regulator 102 may regulate rotation of the motor 106 in a manner as described below.

The media detector and regulator 102 resets the motor 106 to retain the print medium 202 at the de-skew position. Subsequently, during further operations of the printing system 200, when the de-skew roller 216 is moved, the print medium 202 may be forwarded towards the printing unit 212 for printing.

When the de-skew position is detected based on one of a comparison between the current operating torque with the de-skew position torque and a comparison between the torque deviation with the de-skew position torque deviation, the target position is a specific distance beyond the de-skew position. The specific distance beyond the de-skew position may range between 90 mm to 100 mm. In an example implementation, when the target position is the specific distance beyond the de-skew position, the media detector and regulator 102 may regulate rotation of the motor 106 in a manner as described below:

Upon detecting that the print medium 202 is at the de-skew position, the media detector and regulator 102 captures a de-skew position snapshot. The de-skew position snapshot represents an encoder count of the motor 106 indicative of a position of the shaft of the motor 106 when the print medium 202 is at the de-skew position. The media detector and regulator 102 rotates the motor 106 for driving the print medium 202 at a second specific regulated speed for the specific distance beyond de-skew position. In an example implementation, the second specific regulated speed may be 3 ips. When the leading edge L of the print medium 202 covers the specific distance beyond the de-skew position, the motor 106 is stopped. Thus, at the end of this operation the leading edge L of the print medium 202 is between the de-skew unit 210 and the printing unit 212. During the next sequence of operations of the printing system 200, the de-skew roller 216 may be rotated for driving the print medium 202 towards the printing unit 212 for printing.

During printing, the print medium 202 is driven by the feed roller 220. Finally, after printing is performed on the print medium 202, the print medium 202 is dispensed from the printing system 200 by the discharge unit 214.

Figure 3:
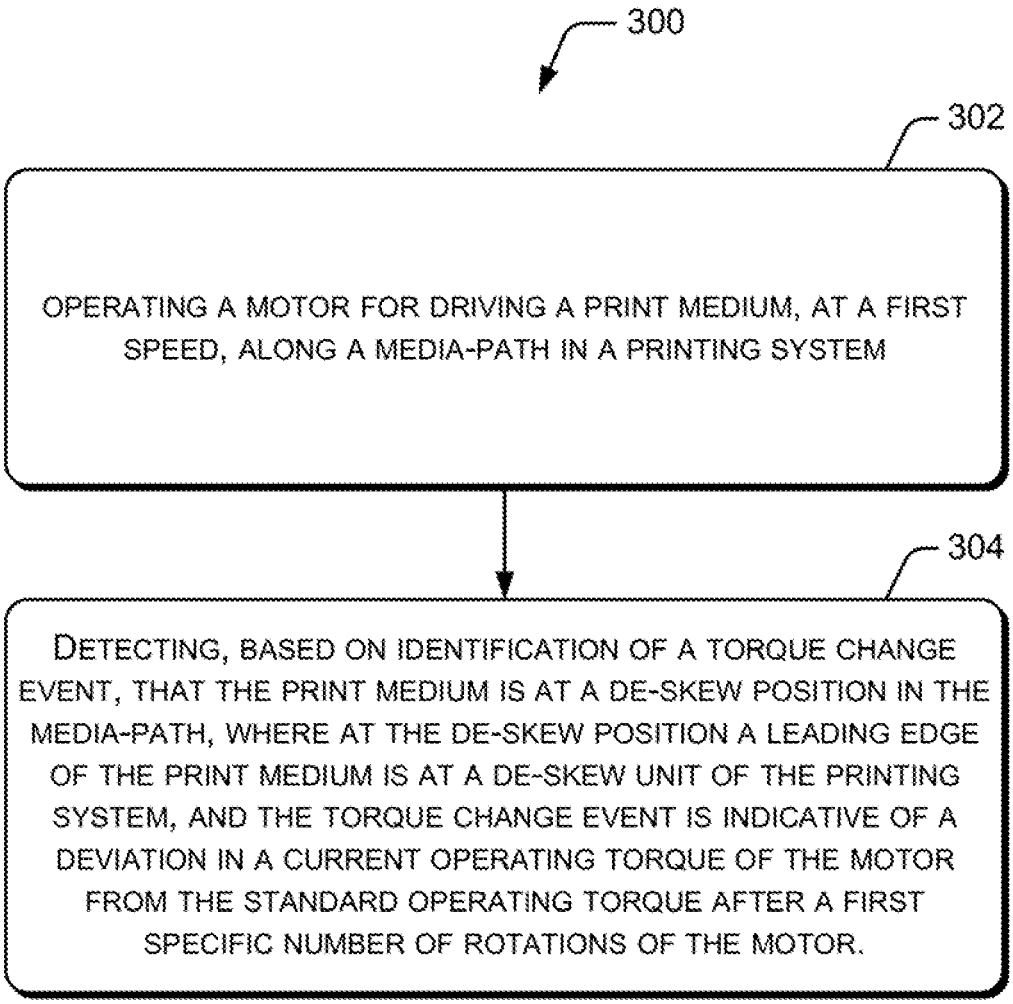
FIG. 3 illustrates a method of detecting position of a print medium for driving the print medium for printing in a printing system, according to an example implementation of the present subject matter.

FIG. 3 illustrates a method of detecting position of a print medium for driving the print medium for printing in the printing system 100, according to an example implementation of the present subject matter. The method 300 can be implemented by processor(s) or computing device(s) through any suitable hardware, a non-transitory machine readable medium, or combination thereof. In an example implementation, the steps of the method 300 as illustrated through blocks 302 and 304 may be performed by a media detector and regulator, such as the media detector and regulator 102, of a printing system, such as the printing system 100. Further, although the method 300 is described in context of the aforementioned printing system 100, other suitable systems may be used for execution of the method 300. It may be understood that processes involved in the method 300 can be executed based on instructions stored in a non-transitory computer readable medium. The non-transitory computer readable medium may include, for example, digital memories, magnetic storage media, such as a magnetic disks and magnetic tapes, hard drives, or optically readable digital data storage media.

Referring to FIG. 3, at block 302, a motor is operated for driving a print medium, at a first specific speed, along a media-path in the printing system 100. Operation of the motor includes rotation of the motor. In an example implementation, the motor may be rotated at a standard operating torque for driving the print medium at the first specific speed. In an example, the standard operating torque may range between 5 ounce-inches to 15 ounce inches and the first specific speed may be 10 inches per second (ips).

At block 304, the print medium is detected to be at a de-skew position based on identification of a torque change event. At the de-skew position a leading edge of the print medium is at a de-skew unit of the printing system 100. The torque change event is indicative of a deviation in a current operating torque of the motor from the standard operating torque after a first specific number of rotations of the motor. In an example implementation, the first specific number of rotations may be pre-set and stored in the memory of the printing system. The first specific number of rotations may range between 6000 encoder counts and 8000 encoder counts.

In an example implementation, upon detecting that the print medium is at the de-skew position, the rotations of the motor may be regulated for driving the print medium to a target position before the print medium is fed to a printing unit of the printing system 100 for printing. The target position of the print medium may be the de-skew position or a specific distance, such as 100 mm, beyond of the de-skew position.

Figure 4:
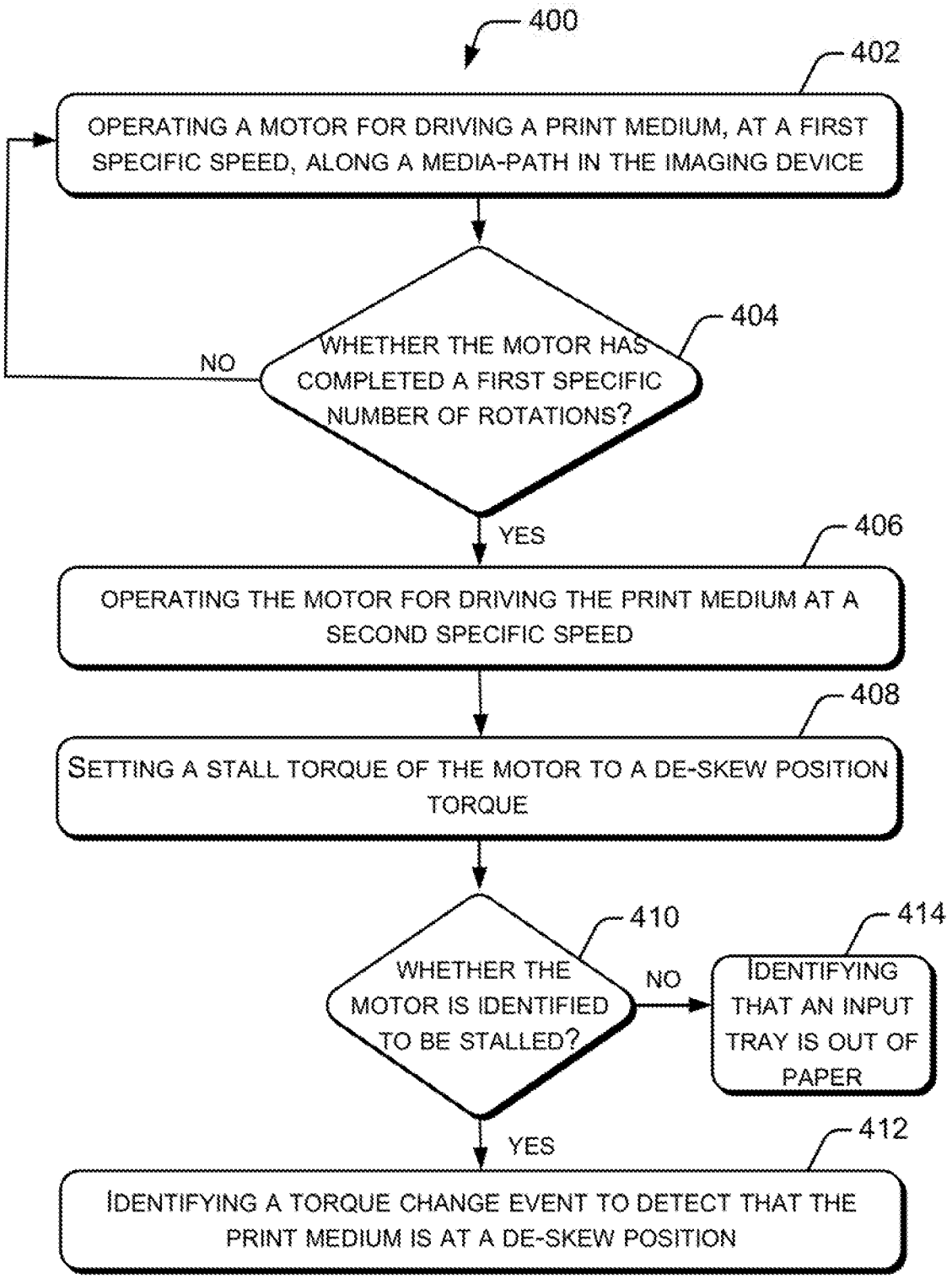
FIG. 4 illustrates a method of detecting that the print medium is at a de-skew position, according to an example implementation of the present subject matter.

An example procedure of detecting that the print medium is at the de-skew position is described through FIG. 4. After detecting that the print medium is at the de-skew position, rotation of the motor may be controlled by the media detector and regulator for executing/scheduling various other functions, such as feeding, printing, etc., of the printing system 100.

FIG. 4 illustrates a method 400 of detecting that a print medium is at a de-skew position, according to an example implementation of the present subject matter. In an example implementation, the steps of the method 400 as illustrated through blocks 402 to 414 may be performed by a media detector and regulator, such as the media detector and regulator 102, of a printing system, such as the printing system 100.

At block 402, a motor is operated for driving the print medium at a first specific speed along a media-path in the printing system. In an example implementation, the first specific speed may be 10 ips. At this step, the motor may be operated to rotate at a standard operating torque. In an example, the standard operating torque may range between 5 ounce inches to 15 ounce inches.

At block 404, an encoder count of the motor is checked to determine whether the motor has completed a first specific number of rotations. In an example implementation, the first specific number of rotations may be pre-set and stored in the memory of the printing system. The first specific number of rotations may range between about 6000 encoder counts to about 8000 encoder counts.

At block 406, when is it determined that the motor has completed the first specific number of rotations, the motor is operated for driving the print medium at a second specific speed. In an example implementation, the second specific speed may be 5 ips.

At block 408, a stall torque of the motor is set as a de-skew position torque. The stall torque may be defined as a torque load that causes the output rotational speed of the motor to become zero, i.e., causes stalling. The de-skew position torque is a specific value of the output torque of the motor when a leading edge of the print medium is at the de-skew unit.

At block 410, it is identified whether the motor is stalled. When a current operating torque of the motor equals the stall torque, the motor is identified to be stalled.

When the motor is identified to be stalled, at block 412 ("yes" branch from block 410), a torque change event is identified to detect that the print medium is at the de-skew position. The torque change event refers to a deviation in the current operating torque of the motor from the standard operating torque.

After a definite number of rotations of the motor, when the motor is not identified to be stalled, at block 414 ("NO branch from block 410"), an input tray of the printing system 100 is identified to be out of paper. In an example implementation, the definite number of rotations may range from about 36000 encoder counts to about 50000 encoder counts of rotation of the motor.

Upon detecting that the print medium is at the de-skew position, the stalled motor is reset and the print medium is retained at the de-skew position. Subsequently, during further operations of the printing system 100, the print medium 202 may be forwarded towards a printing unit of the printing system for printing.

Figure 5:
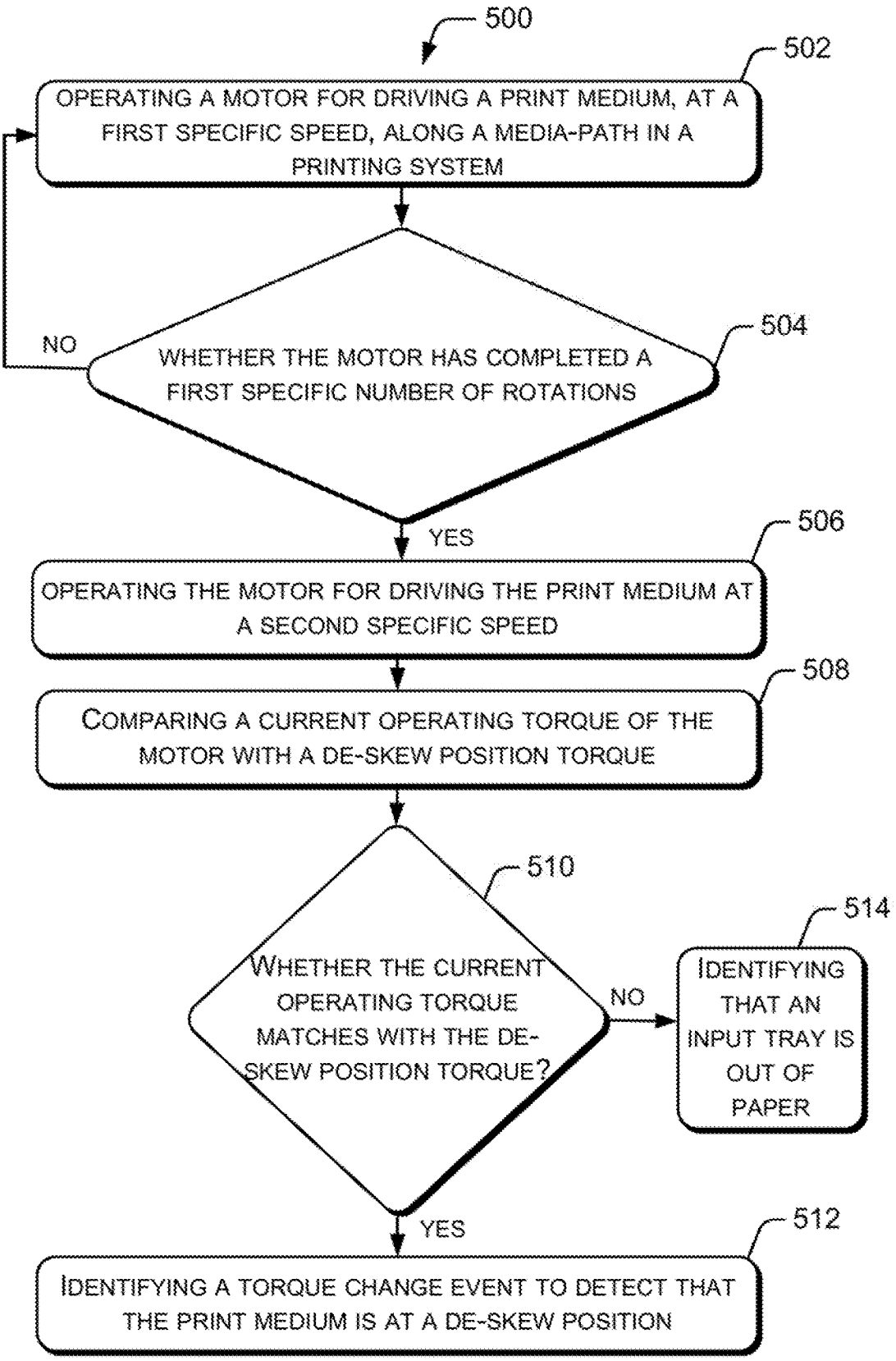
FIG. 5 illustrates a method of detecting that the print medium is at the de-skew position, according to an example implementation of the present subject matter.

FIG. 5 illustrates another method 500 of detecting that a print medium is at a de-skew position, according to an example implementation of the present subject matter. In an example implementation, the steps of the method 500 as illustrated through blocks 502 to 514 may be performed by a media detector and regulator, such as the media detector and regulator 102, of a printing system, such as the printing system 100.

Blocks 502 to 506 of FIG. 5 are identical to blocks 402 to 406 of FIG. 4.

At block 508, the current operating torque of the motor is compared with a de-skew position torque. The de-skew position torque is a specific value of an output torque of the motor when the print medium is at the de-skew position.

At block 510, the current operating torque is checked to determine whether the current operating torque matches with the de-skew position torque.

When the current operating torque matches with the de-skew position torque, at block 512 ("YES" branch from block 510), a torque change event is identified to detect that the print medium is at the de-skew position. The torque change event refers to the deviation in the current operating torque from the standard operating torque to the de-skew position torque.

After a definite number of rotations of the motor, when the current operating torque does not match with the de-skew position torque, at block 514 ("NO" branch from block 510), it is identified that an input tray of the printing system 100 is out-of-paper. In an example implementation, the definite number of rotations may range from about 36000 encoder counts to about 50000 encoder counts of rotation of the motor.

Figure 6:
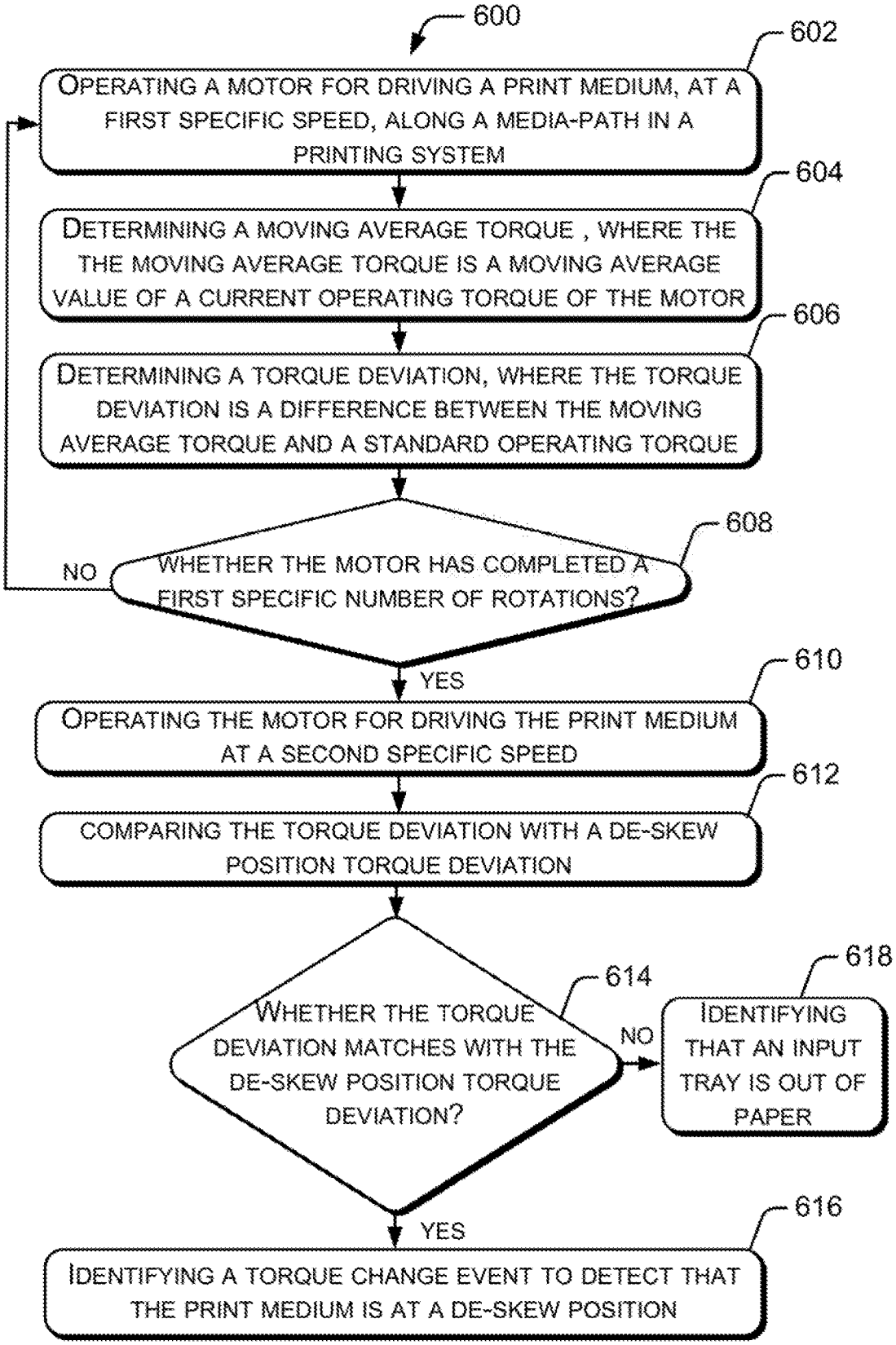
FIG. 6 illustrates a method of detecting that a print medium is at the de-skew position, according to an example implementation of the present subject matter.

FIG. 6 illustrates another method 600 of detecting that a print medium is at a de-skew position, according to an example implementation of the present subject matter. In an example implementation, the steps of the method 600 as illustrated through blocks 602 to 614 may be performed by a media detector and regulator, such as the media detector and regulator 102, of a printing system, such as the printing system 100.

At block 602, a motor of a printing system, such as the printing system shown in FIG. 2, is operated for driving the print medium at a first specific speed along a media-path in the printing system. In an example implementation, the first specific speed may be 10 ips. At this step, the motor may be operated to rotate at a standard operating torque. In an example, the standard operating torque may range between 5 ounce inches to 15 ounce inches.

At block 604, a moving average torque of the motor is determined. The moving average torque is a moving average value of a current operating torque of the motor.

At block 606, a torque deviation of the motor is determined. The torque deviation is a difference between the moving average torque and the standard operating torque.

At block 608, an encoder count of the motor is checked to determine whether the motor has completed a first specific number of rotations. In an example implementation, the first specific number of rotations may be pre-set and stored in a memory of the printing system. The first specific number of rotations may range from about 6000 encoder counts to about 8000 encoder counts.

At block 610, when it is determined that the motor has completed the first specific number of rotations, the motor is operated for driving the print medium at a second specific speed. In an example implementation, the second specific speed may be 5 ips.

At block 612, the torque deviation is compared with a de-skew position torque deviation. The de-skew position torque deviation is a specific difference between a moving average torque of the motor when the print medium is at the de-skew position and the standard operating torque. In an example implementation, the de-skew position torque deviation may be 50% to 100% of the standard operating torque.

At block 614, it is checked whether the torque deviation matches with the de-skew position torque deviation.

When the torque deviation matches with the de-skew position torque deviation, at block 616 ("YES" branch from block 614) a torque change event is identified to detect that the print medium is at the de-skew position. The torque change event is indicative of a deviation in the current operating torque of the motor from the standard operating torque.

After a definite number of rotations of the motor, when the torque deviation does not match with the de-skew position torque deviation, at block 618 ("NO" branch from block 510), it is identified that an input tray of the printing system is out-of-paper. In an example implementation, the definite number of rotations may range from about 36000 encoder counts to about 50000 encoder counts of rotation of the motor.

Figure 7:
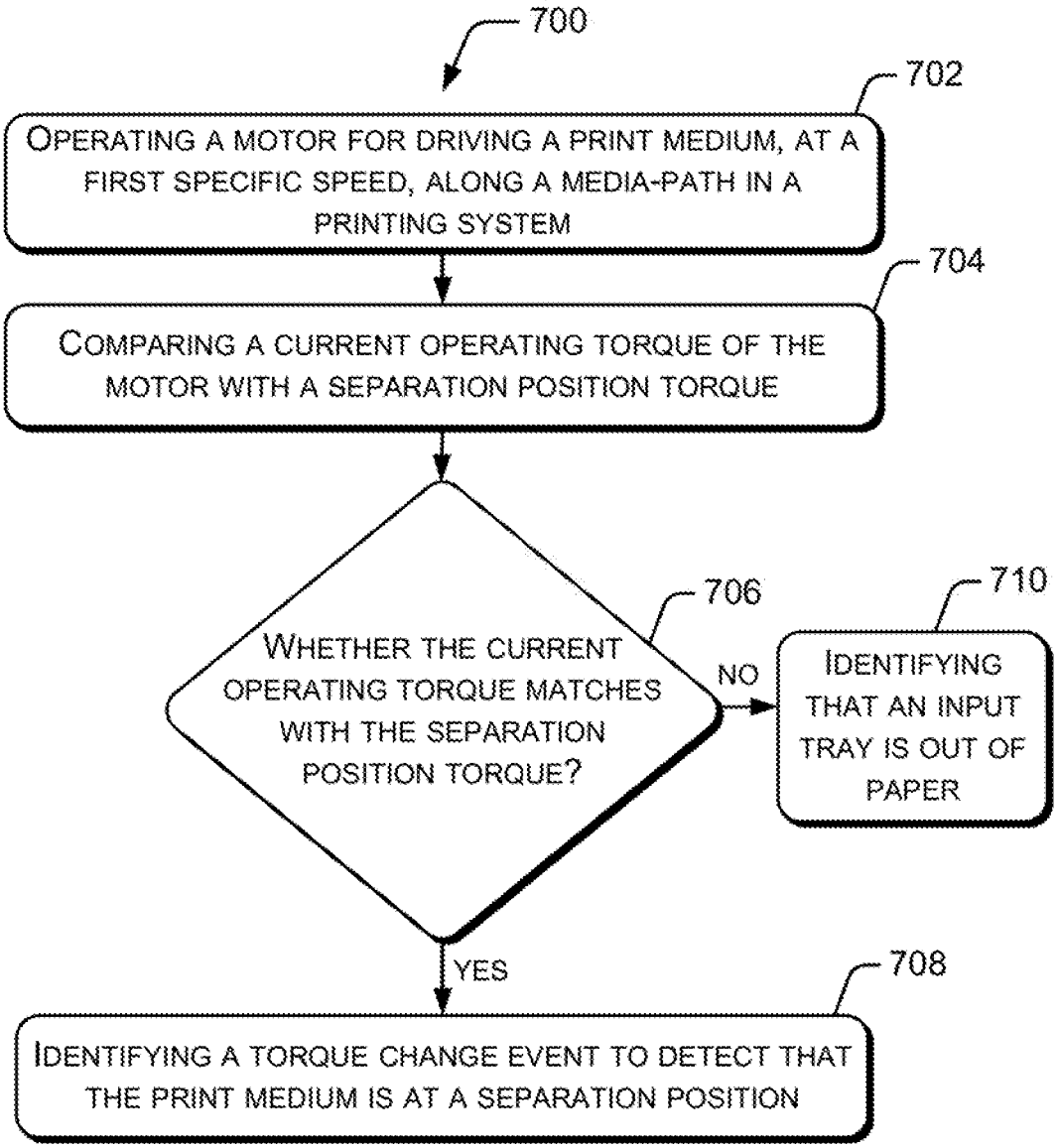
FIG. 7 illustrates a method of detecting that the print medium is at a separation position, according to an example implementation of the present subject matter.

FIG. 7 illustrates a method 700 of detecting that a print medium is at a separation position, according to an example implementation of the present subject matter. In an example implementation, the steps of the method 700 as illustrated through blocks 702 to 710 may be performed by a media detector and regulator, such as the media detector and regulator 102, of a printing system, such as the printing system 100.

With reference to FIG. 7, at block 702, a motor is operated for driving the print medium at a first specific speed along a media-path in the printing system. In an example implementation, the first specific speed may be 10 ips. At this step, the motor may be operated to rotate at a standard operating torque.

At block 704, a current operating torque of the motor is compared with a separation position torque. The separation position torque is a specific output torque of the motor when a leading edge of the print medium is at a separation unit.

At block 706, it is checked whether the current operating torque matches with the separation position torque.

At block 708, ("YES" branch from block 706), when the current operating torque matches with the separation position torque, another torque change event is identified to detect that the print medium is at the separation position.

Once it is detected that the print medium is at the separation position, in an example implementation, a separation position snapshot may be captured. The separation position snapshot is indicative of a position of the shaft of the motor when the print medium is at the separation position. Then the motor may be operated for driving the print medium at a second specific regulated speed towards the de-skew unit of the printing system 100.

As the print medium moves towards the de-skew unit at the second specific regulated speed, the method as illustrated through block 504 to block 512 of FIG. 5 may be executed to detect that the print medium is at the de-skew position.

After a definite number of rotations of the motor, when the current operating torque does not match with the separation position torque, at block 710 ("NO" branch from block 706), it is identified that an input tray of the printing system is out of paper. In an example implementation, the definite number of rotations may range from about 36000 encoder counts to about 50000 encoder counts of the motor.

Figure 8:
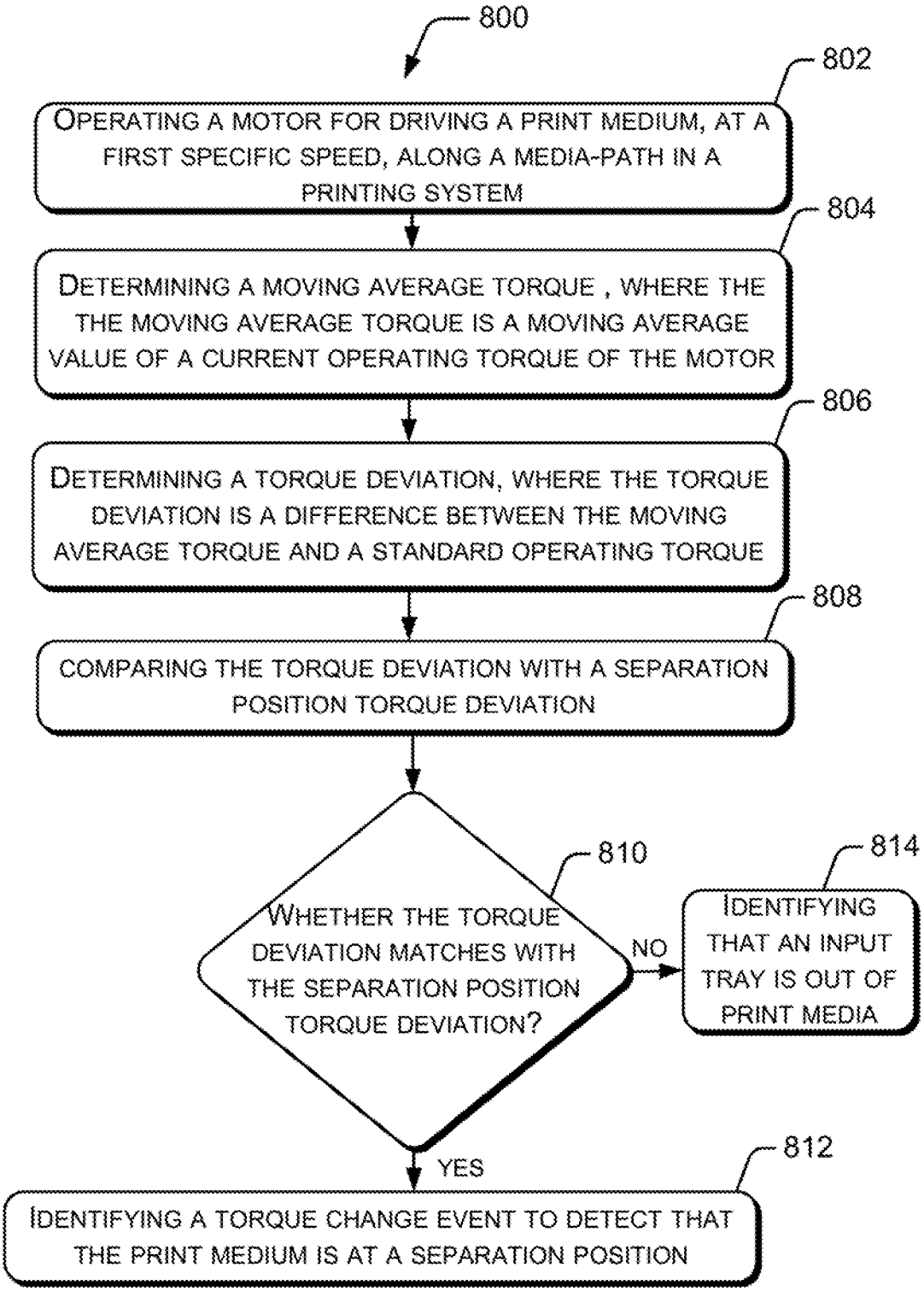
FIG. 8 illustrates a method of detecting that the print medium is at the separation position, according to an example implementation of the present subject matter.

FIG. 8 illustrates another method 800 of detecting that a print medium is at a separation position, according to an example implementation of the present subject matter. In an example implementation, the steps of the method 800 as illustrated through blocks 802 to 814 may be performed by a media detector and regulator, such as the media detector and regulator 102, of a printing system, such as the printing system 100.

At block 802, the motor is operated for driving the print medium at a first specific speed along a media-path in the printing system. At this step, the motor may be operated to rotate at a standard operating torque.

At block 804, a moving average torque of the motor is determined. The moving average torque is a moving average value of a current operating torque of the motor.

At block 806, a torque deviation of the motor is determined. The torque deviation is a difference between the moving average torque and the standard operating torque.

At block 808, the torque deviation is compared with a separation position torque deviation. The separation position torque deviation is a specific difference between a moving average torque of the motor when the print medium is at the separation position and the standard operating torque. In an example implementation, the separation position torque deviation may be 50% to 100% of the standard operating torque.

At block 810, it is checked whether the torque deviation matches with the separation position torque deviation.

When the torque deviation matches with the separation position torque deviation, at block 812 ("YES" branch from block 810), a torque change event is identified to detect that the print medium is at the separation position. The torque change event is indicative of a deviation in the current operating torque of the motor from the standard operating torque.

As explained in the description of FIG. 7, once it is detected that the print medium is at the separation position, the separation position snapshot may be captured and the motor may be operated for driving the print medium at the second specific regulated speed towards the de-skew unit of the printing system.

As the print medium moves towards the de-skew unit at the second specific regulated speed, the method as illustrated through block 608 to block 616 of FIG. 6 may be executed to detect that the print medium is at the de-skew position.

After a definite number of rotations of the motor, when the torque deviation does not match with the separation position torque deviation, at block 814 ("NO" branch from block 810), the input tray of the printing system is identified to be out-of-paper. In an example implementation, the definite number of rotations may range from about 36000 encoder counts to about 50000 encoder counts of the motor.

Figure 9:
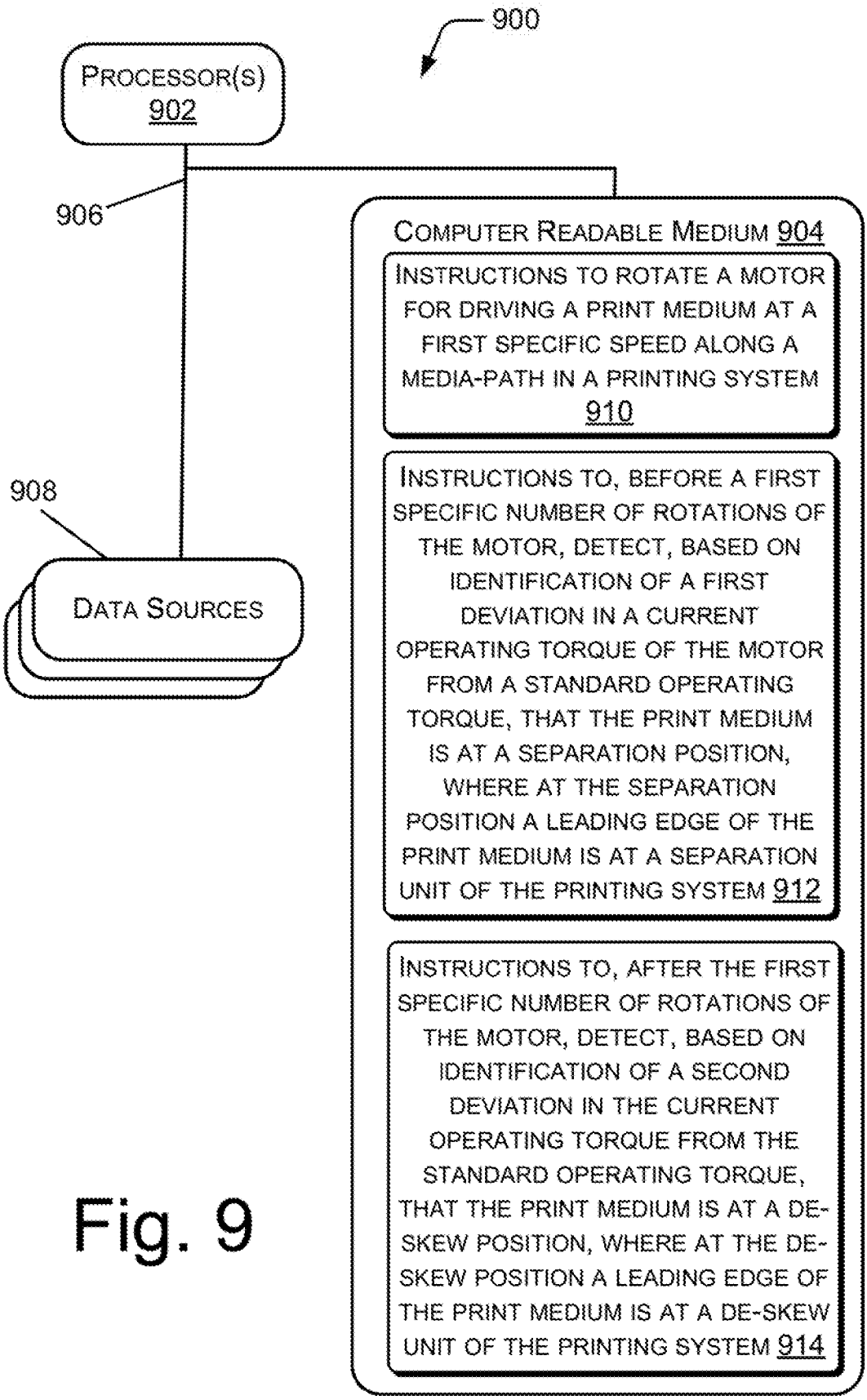
FIG. 9 illustrates a printing system for detection of positions of the print medium for driving the print medium for printing in a printing system, according to an example implementation of the present subject matter.

FIG. 9 illustrates a printing system 900 for detection of positions of a print medium for driving the print medium for printing in the printing system 900, according to an example implementation of the present subject matter. In an example implementation, the printing system 900 includes processor(s) 902 communicatively coupled to a non-transitory computer readable medium 904 through a communication link 906. In an example, the processor(s) 902 may have one or more processing resources for fetching and executing computer-readable instructions from the non-transitory computer readable medium 904.

The non-transitory computer readable medium 904 can be, for example, an internal memory device or an external memory device. In an example implementation, the communication link 906 may be a direct communication link, such as any memory read/write interface.

The processor(s) 902 and the non-transitory computer readable medium 904 may also be communicatively coupled to data sources 908 over the network. The data sources 908 can include, for example, memory of the printing system 900.

In an example implementation, the non-transitory computer readable medium 904 includes a set of computer readable instructions which can be accessed by the processor(s) 902 through the communication link 906 and subsequently executed to perform acts for detecting positions of the print medium in a media-path of the printing system 900.

Referring to FIG. 9, in an example, the non-transitory computer readable medium 904 includes instructions 910 that cause the processor(s) 902 to rotate a motor for driving the print medium at a first specific speed along a media-path in the printing system 900.

The non-transitory computer readable medium 904 includes instructions 912 that cause the processor(s) 902 to detect, based on identification of a first deviation in a current operating torque of the motor from a standard operating torque, before a first specific number of rotations of the motor, that the print medium is at a separation position. At the separation position a leading edge of the print medium is at a separation unit of the printing system 900.

In an example implementation, the non-transitory computer readable medium 904 includes instructions 914 that cause the processor(s) 902 to detect, based on identification of a second deviation in the current operating torque from the standard operating torque, after a first specific number of rotations of the motor, that the print medium is at a de-skew position. At the de-skew position a leading edge of the print medium is at a de-skew unit of the printing system 900.

In an example implementation, the non-transitory computer readable medium 904 includes instructions that cause the processor(s) 902 to detect that the print medium is at the separation position and at the de-skew position according to method(s) described earlier in conjunction with description of FIGS. 4 to 8.

Although implementations of detecting positions of a print medium for driving the print medium for printing in a printing system have been described in language specific to structural features and/or methods, it is to be understood that the present subject matter is not limited to the specific features or methods described. Rather, the specific features and methods are disclosed and explained as example implementations for detecting positions of the print medium for driving the print medium for printing.

We claim:

1. A method of detecting position of a print medium for driving the print medium for printing in a printing system, comprising:

operating a motor for driving the print medium, at a first specific speed, along a media-path in the printing system; and detecting, based on identification of a torque change event, that the print medium is at a de-skew position in the media-path, wherein at the de-skew position a leading edge of the print medium is at a de-skew unit of the printing system, the torque change event being indicative of a deviation in a current operating torque of the motor from a standard operating torque of the motor after a first specific number of rotations of the motor, wherein detecting that the print medium is at the de-skew position comprises:

determining a moving average torque of the motor, wherein the moving average torque is a moving average value of the current operating torque of the motor;

determining a torque deviation, wherein the torque deviation is a difference between the moving average torque and the standard operating torque;

checking whether the motor has completed the first specific number of rotations; when the motor has completed the first specific number of rotations, operating the motor for driving the print medium at a second specific speed;

comparing the torque deviation with a de-skew position torque deviation, wherein the de-skew position torque deviation is a specific difference between a moving average torque of the motor when the leading edge of the print medium is at the de-skew unit and the standard operating torque; and when the torque deviation of the motor matches with the de-skew position torque deviation, identifying the torque change event to detect that the print medium is at the de-skew position.

2. The method as claimed in claim 1, wherein detecting that the print medium is at the de-skew position comprises:

checking whether the motor has completed the first specific number of rotations; and when the motor has completed the first specific number of rotations, operating the motor for driving the print medium at a second specific speed;

setting a stall torque of the motor to a de-skew position torque, wherein the de-skew position torque is a specific torque value of the motor when the print medium is at the de-skew position;

when the current operating torque of the motor equals the stall torque, identifying that the motor is stalled; and when the motor is stalled, identifying the torque change event to detect that the print medium is at the de-skew position.

3. The method as claimed in claim 1, wherein detecting that the print medium is at the de-skew position comprises:

checking whether the motor has completed the first specific number of rotations;

when the motor has completed the first specific number of rotations, operating the motor for driving the print medium at a second specific speed;

comparing the current operating torque of the motor with a de-skew position torque, wherein the de-skew position torque is a specific torque value of the motor when the print medium is at the de-skew position; and when the current operating torque of the motor matches with the de-skew position torque, identifying the torque change event to detect that the print medium is at the de-skew position.

4. The method as claimed in claim 1, further comprising:

prior to detecting that the print medium is at the de-skew position, detecting, based on identification of another torque change event of the motor, that the print medium is at a separation position in the media-path, wherein at the separation position a leading edge of the print medium is at a separation unit of the printing system, the other torque change event indicative of a deviation in the current operating torque of the motor from the standard operating torque before the first specific number of rotations of the motor.

5. The method as claimed in claim 4, wherein detecting that the print medium is at the separation position comprises:

comparing the current operating torque of the motor with a separation position torque, wherein the separation position torque is a specific torque value of the motor when the print medium is at the separation unit; and when the current operating torque of the motor matches with the separation position torque, identifying the other torque change event to detect that the print medium is at the separation position.

6. The method as claimed in claim 4, wherein detecting that the print medium is at the separation position comprises:

determining a moving average torque, wherein the moving average torque is a moving average value of the current operating torque of the motor;

determining a torque deviation, wherein the torque deviation is a difference between the moving average torque and the standard operating torque;

comparing the torque deviation with a separation position torque deviation, wherein the separation position torque deviation is a specific difference between a moving average torque of the motor when the leading edge of the print medium is at the separation unit and the standard operating torque; and when the torque deviation matches with the separation position torque deviation, identifying the other torque change event to detect that the print medium is at the separation position.

7. A printing system comprising:

an input tray;

a motor for driving a print medium from the input tray along a media-path in the printing system:

a media detector and regulator to:

rotate the motor at a standard operating torque for driving the print medium at a first specific speed along the media-path;

after a first specific number of rotations of the motor, detect, based on identification of a deviation in a current operating torque of the motor from the standard operating torque, that the print medium is at a de-skew position, wherein at the de-skew position a leading edge of the print medium is at a de-skew unit of the printing system; and wherein to detect that the print medium is at the de-skew position, the media detector and regulator is to:

determine a moving average torque of the motor, wherein the moving average torque is a moving average value of the current operating torque of the motor;

determine a torque deviation, wherein the torque deviation is a difference between the moving average torque and the standard operating torque;

check whether the motor has completed the first specific number of rotations: when the motor has completed the first specific number of rotations, rotate the motor for driving the print medium at a second specific speed;

compare the torque deviation with a de-skew position torque deviation, wherein the de-skew position torque deviation is a specific difference between a moving average torque of the motor when the leading edge of the print medium is at the de-skew unit and the standard operating torque, and when the torque deviation of the motor matches with the de-skew position torque deviation, identify the torque change event to detect that the print medium is at the de-skew position.

8. The printing system as claimed in claim 7, wherein to detect that the print medium is at the de-skew position, the media detector and regulator is to:

check whether the motor has completed the first specific number of rotations; and when the motor has completed the first specific number of rotations, rotate the motor for driving the print medium at a second specific speed;

setting a stall torque of the motor to a de-skew position torque, wherein the de-skew position torque is a specific torque value of the motor when the print medium is at the de-skew position;

when the current operating torque of the motor equals the stall torque, identify that the motor is stalled; and when the motor is stalled, identify the deviation in the current operating torque of the motor from the standard operating torque to detect that the print medium is at the de-skew position.

9. The printing system as claimed in claim 7, wherein to detect that the print medium is at the de-skew position, the media detector and regulator is to:

check whether the motor has completed the first specific number of rotations; and when the motor has completed the first specific number of rotations, rotate the motor for driving the print medium at a second specific speed;

compare the current operating torque of the motor with a de-skew position torque, wherein the de-skew position torque is a specific torque value of the motor when the print medium is at the de-skew unit; and when the current operating torque of the motor matches with the de-skew position torque, identify the deviation in the current operating torque to detect that the print medium is at the de-skew position.

10. The printing system as claimed in claim 7, wherein the media detector and regulator is to:

before the first specific number of rotations of the motor, detect, based on identification of another deviation in the current operating torque of the motor from the standard operating torque, that the print medium is at a separation position in the media-path, wherein at the separation position a leading edge of the print medium is at a separation unit of the printing system; and when it is determined that the print medium is at the separation position, regulate rotation of the motor to move the print medium from the separation position towards the de-skew position.

11. A non-transitory computer-readable medium comprising computer-readable instructions for detecting position of a print medium for driving the print medium for printing in a printing system, the computer-readable instructions when executed by a processor, cause the processor to:

rotate a motor for driving the print medium at a first specific speed along a media-path in the printing system;

before a first specific number of rotations of the motor, detect, based on identification of a first deviation in a current operating torque of the motor from a standard operating torque, that the print medium is at a separation position, wherein at the separation position a leading edge of the print medium is at a separation unit of the printing system;

after the first specific number of rotations of the motor, detect, based on identification of a second deviation in the current operating torque from the standard operating torque, that the print medium is at a de-skew position, wherein at the de-skew position a leading edge of the print medium is at a de-skew unit of the printing system; and wherein the instructions to detect, based on identification of the second deviation, that the print medium is at the de-skew position, when executed by the processor, cause the processor to:

determine a moving average torque of the motor, wherein the moving average torque is a moving average value of the current operating torque of the motor;

determine a torque deviation, wherein the torque deviation is a difference between the moving average torque and the standard operating torque;

check whether the motor has completed the first specific number of rotations; when the motor has completed the first specific number of rotations, rotate the motor for driving the print medium at a second specific speed;

compare the torque deviation with a de-skew position torque deviation, wherein the de-skew position torque deviation is a specific difference between a moving average torque of the motor when the leading edge of the print medium is at the de-skew unit and the standard operating torque, and when the torque deviation of the motor matches with the de-skew position torque deviation, identify the torque change event to detect that the print medium is at the de-skew position.

12. The non-transitory computer-readable medium as claimed in claim 11, wherein the instructions to detect, based on identification of the second deviation, that the print medium is at the de-skew position, when executed by the processor, cause the processor to:

check whether the motor has completed the first specific number of rotations;

when the motor has completed the first specific number of rotations, rotate the motor for driving the print medium at a second specific speed; and compare the current operating torque of the motor with a de-skew position torque, wherein the de-skew position torque is a specific torque value of the motor when the print medium is at the de-skew unit; and when the current operating torque of the motor matches with the de-skew position torque, identify the second deviation to detect that the print medium is at the de-skew position.

* * * * *